US011587409B2

(12) United States Patent
Kwan

(10) Patent No.: US 11,587,409 B2
(45) Date of Patent: Feb. 21, 2023

(54) SANITIZING SELF-SERVICE TERMINAL

(71) Applicant: NCR Corporation, Duluth, GA (US)

(72) Inventor: Sik Piu Kwan, Suwanee, GA (US)

(73) Assignee: NCR Corporation, Atlanta, GA (US)

( * ) Notice: Subject to any disclaimer, the term of this patent is extended or adjusted under 35 U.S.C. 154(b) by 103 days.

(21) Appl. No.: 17/147,893

(22) Filed: Jan. 13, 2021

(65) Prior Publication Data

US 2022/0223012 A1 Jul. 14, 2022

(51) Int. Cl.
*G07F 19/00* (2006.01)

(52) U.S. Cl.
CPC ..... *G07F 19/203* (2013.01); *G07F 19/201* (2013.01)

(58) Field of Classification Search
None
See application file for complete search history.

(56) References Cited

U.S. PATENT DOCUMENTS 4,927,003 A * 5/1990 Swinderman ..... B65G 45/12 198/497
5,336,319 A * 8/1994 Narang ..... B05C 1/02 101/477
8,783,558 B2 7/2014 Latimer
8,915,426 B2 12/2014 Henderson et al.
2006/0159494 A1* 7/2006 Hirai ..... G03G 15/1685 399/303
2015/0376831 A1* 12/2015 Ingle ..... A61L 2/04 68/5 D
2016/0147172 A1* 5/2016 Watanabe ..... G03G 15/0808 399/272
2016/0272448 A1* 9/2016 Nakai ..... B65H 5/062
2016/0331175 A1* 11/2016 Johncock ..... A47J 37/049
2018/0249736 A1* 9/2018 Tang ..... A23L 3/001
2019/0181461 A1* 6/2019 Weber ..... H01M 8/0273

OTHER PUBLICATIONS

"Disinfecting banknotes at a speedy 1,000 notes/min, Dec. 8, 2020, Hitachi-Omron Terminal Solutions develops currency disinfector, Hitachi." (Year: 2020).*
Chin, Alex W.H. et al., Stability of SARS-CoV-2 in different environmental conditions, The Lancet, May 2020, vol. 1.

* cited by examiner

*Primary Examiner* — Kito R Robinson
*Assistant Examiner* — Toan Duc Bui
(74) *Attorney, Agent, or Firm* — Notaro, Michalos & Zaccaria, P.C.; John S. Economou

(57) ABSTRACT

A self-service terminal has a bin for storing media items. A mechanism is coupled to the bin that has a pathway for selectively conveying a media item from the bin to a dispenser. A heater device is mounted in the pathway for sanitizing the media item as it is conveyed to the dispenser. The heater device has a heating element set to a predetermined temperature and a roller driven by a motor set to move the media item past the heating element at a predetermined rate of speed. By selecting the predetermined temperature to 116° C. and the predetermined rate of speed to 181 mm/sec, 99.9999% of the viral load of a known type pathogen, i.e., SARS-CoV-2, is eliminated from the media item by the sanitization process.

20 Claims, 3 Drawing Sheets

300

Viral log10 Reduction @ given temperature and @ given sanitization time.

| Viral Reduction | | Temperature setting | | | | |
|---|---|---|---|---|---|---|
| (%) | (log10) | 66 C | 78 C | 91 C | 103 C | 116 C |
| 90% | 1 | 60 s | 6 s | 0.6 s | 0.06 s | 0.006 s |
| 99% | 2 | 120 s | 12 s | 1.2 s | 0.12 s | 0.012 s |
| 99.9% | 3 | 180 s | 18 s | 1.8 s | 0.18 s | 0.018 s |
| 99.99% | 4 | 240 s | 24 s | 2.4 s | 0.24 s | 0.024 s |
| 99.999% | 5 | 300 s | 30 s | 3.0 s | 0.30 s | 0.030 s |
| 99.9999% | 6 | 360 s | 36 s | 3.6 s | 0.36 s | 0.036 s |

SANITIZING SELF-SERVICE TERMINAL

FIELD

This disclosure relates generally to a sanitizing self-service terminal, and more particularly to a self-service terminal such as an automatic teller machine (ATM) adapted to sanitize banknotes (paper money) or other media items dispensed therefrom.

BACKGROUND

Pathogens such as bacteria, protozoa, and viruses are infectious agents that can cause disease in humans and thus constitute a significant health hazard. A single banknote (e.g., a U.S. dollar bill) may be in circulation for over five years and may be handled by hundreds of people over the course of that time. The fibrous surface of many types of banknotes can harbor many types of pathogens, making each banknote in circulation a potential source of infection, depending on who has recently handled such banknote. These pathogens can also exist on banknotes formed from a polymer. Polymer banknotes are used in a number of countries outside the U.S. and typically can withstand a temperature of 120° C. without becoming deformed.

There are a number of ways to kill such pathogens, including, inter alia, high levels of heat, application of ultraviolet light, and use of disinfectants. Each of these methods presents certain challenges when applied to kill or greatly reduce the incidence of pathogens on banknotes issued by a self-service terminal. For heat, the main challenge involves balancing the amount of heat applied with the duration of application of heat in order to ensure that the level of pathogens remaining on the banknotes is significantly reduced. The application of ultraviolet light has similar challenges, balancing the intensity of the light and timing issues. The use of disinfectants is difficult to implement in the context of a self-service terminal.

Accordingly, there is a need for a sanitizing self-service terminal that sanitizes banknotes as the banknotes are being withdrawn in order to significantly reduce a customer's exposure to any pathogens present on banknotes stored within the self-service terminal.

BRIEF DESCRIPTION OF THE DRAWINGS

The following detailed description, given by way of example and not intended to limit the present disclosure solely thereto, will best be understood in conjunction with the accompanying drawings in which.

DETAILED DESCRIPTION

In the present disclosure, like reference numbers refer to like elements throughout the drawings, which illustrate various exemplary embodiments of the present disclosure.

Figure 1:
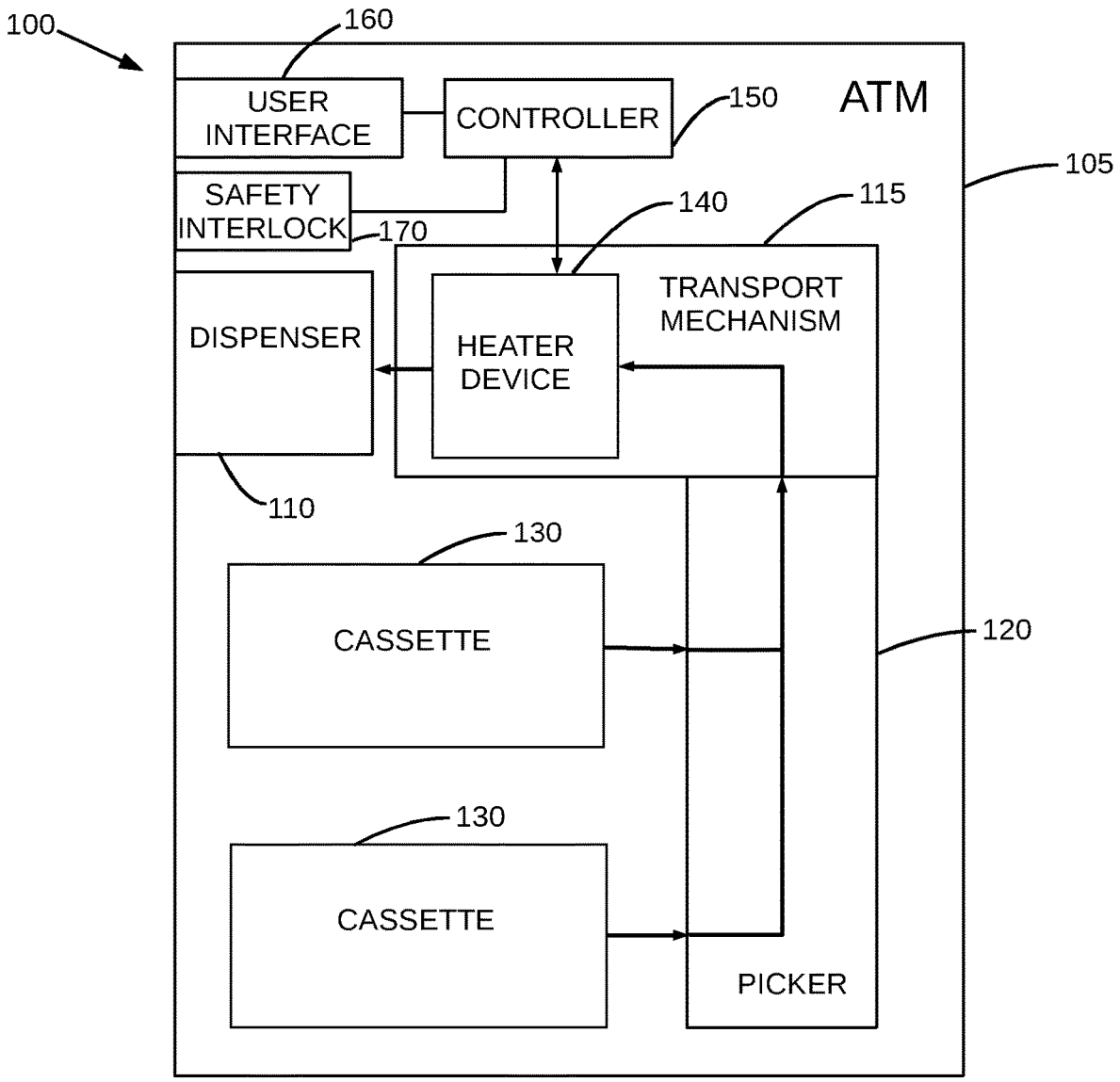
FIG. 1 is a block diagram of a sanitizing self-service terminal according to the present disclosure.

Referring now to FIG. 1, a sanitizing self-service terminal 100 is shown which employs a heater device 140 to sanitize media items being dispensed therefrom. In one embodiment, sanitizing self-service terminal 100 is an automatic teller machine that dispenses media items in the form of cash money (banknotes) in response to a user transaction conducted via a user interface 160. However, sanitizing self-service terminal 100 can be used in any application in which a self-service terminal dispenses a media item, e.g., a travel ticket, an admission ticket, a lottery ticket, etc.

Self-service terminal 100 is shown in FIG. 1 as an automatic teller machine (ATM) in a housing 105 that has two storage bins in the form of cassettes 130 for holding different denominations of banknotes. In other embodiments, each of the cassettes 130 would contain different types of media items. Further, the use of a replaceable cassette is optional and media items can also be stored in fixed bins. Although there are two cassettes 130 shown in FIG. 1, only one cassette is necessary (e.g., for self-service terminals which dispense only a single type of media item) and other applications could include more than two cassettes. A picker 120 is coupled to each cassette 130 to selectively pull a media item from one of the two cassettes 130 based on a current transaction. The picker 120 forwards the media item to a transport mechanism 115. The transport mechanism 115 moves the media item along a pathway in a conventional manner to a dispenser 110 where the media item is presented to a user. In some cases, the picker 120 may be omitted and the media item may be conveyed (transferred) directly to transport mechanism 115. The heater device 140 is positioned along the transport mechanism 115 in order to sanitize the media item before it is presented to the user. A controller 150 is coupled to the user interface 160 in order to manage each user transaction. The controller 150 is also coupled to the heater device 140 in order to activate a heater element within heater device 140, as discussed in more detail below. A safety interlock switch 170 may also be provided that is coupled to a service panel (not shown) for the self-service terminal 100. The safety interlock switch 170 is coupled to controller 150 and changes state when the service panel is opened. The controller 150 deactivates the heater device 140 when the safety interlock switch 170 signals that the service panel is open.

Figures 2, 3:
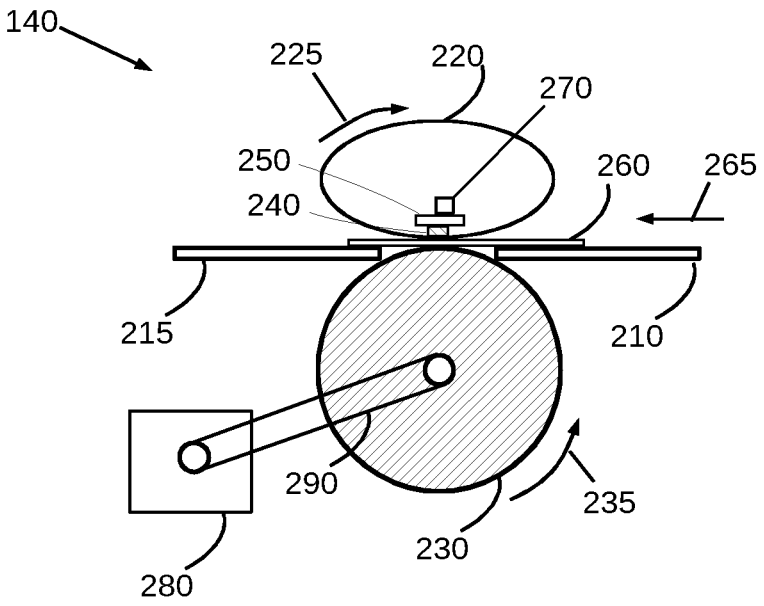
FIG. 2 is a diagram of the fuser element of the sanitizing self-service terminal of FIG. 1.
FIG. 3 is a Thermal Resistance Curve Table for use in determining the proper speed and temperature of the heated roller for the sanitizing self-service terminal of FIG. 1.

Referring now to FIG. 2, the heater device 140 is formed in a similar manner to a laser printer fuser element. In a presently preferred embodiment, the heater device 140 includes a lower roller 230 which rotates in a counter-clockwise manner shown by arrow 235 and a thin metallic sleeve 220 which rotates in a clockwise manner shown by arrow 225. Sleeve 220 may also be formed from a polymer. A heating element 240 is mounted on a support element 250. The heating element 240 may be a ceramic heater as known in the art. Media items to be sanitized are fed the heater device 140 in the direction of arrow 265 via an input pathway 210 and leave the heater device 140 via output pathway 215. A temperature sensor 270 (e.g., a thermistor) is mounted adjacent to or is part of the heating element 240 in order to control the temperature of the heating element 240 and ensure that an appropriate temperature (discussed below) is applied to any media item (such as media item 260) as it passes between roller 230 and metallic sleeve 220. A motor 280 is coupled to roller 230 via a belt 290 in order to control the rate of speed at which media item 260 moves through the heating zone under heating element 240. Motor 280 may be coupled to roller 230 in other ways, e.g., directly to a shaft of roller 230. In an alternative arrangement, the metallic sleeve 220 and the heating element 240 may be replaced by a hollow tube (heat roller) with a radiant heat lamp is suspended in the center thereof—the radiant heat lamp heating the heat roller from the inside, as known in the laser printer fuser element art.

A number of advantages are provided by implementing a heater device 140 based on laser printer fuser element. First, the mechanical arrangement these types of devices make it inherently safe because it is difficult for a service person to directly contact the hot surface of the heater element as it is located within a metal tube or heat roller. For added safety, when the safety interlock switch 170 shown in FIG. 1 is implemented so that it ensured that no power is provided to the heater device 140 whenever the service panel is open. In addition, laser print fusers have a very short warm-up time and thus provide a solution with a short dispense-time latency. A conventional laser print fuser has a typical latency time of about 8.5 seconds to reach a temperature of 213° C. Since, as discussed below, the heater device 140 is preferably set to 116° C., heater device 140 has a warm-up latency time of about half that (approximately 4 seconds). This time can be reduced by activating heater device 140 upon the initiation of a withdrawal event at the self-service terminal 100, instead of waiting for an actual withdrawal to be completed.

In addition, the use of a heater device 140 based on laser printer fuser technology ensures that dispensing throughput is maintained. A typical heating element 240 has a width of 6.5 mm. As discussed below, the preferred sanitization time is 36 msec, which means that the transport speed to provide this sanitization time is 181 mm/sec (heating element width/sanitization time). Most media items being dispensed have a shorter height and a longer width. For example, U.K. banknotes typically are about 80 mm wide. This means that when a transport speed of 181 mm/sec is used, heater device 140 sanitizes 2.25 banknotes per second. The Link Cash Machine Network has indicated an average of £50 per cash withdrawal. By assuming that four banknotes (two £20 notes and two £5 notes) are dispensed during this withdrawal process, the sanitization/dispense time is less than two seconds—adequate for most ATM applications in view of the benefits added by the sanitization process. If a faster throughput is necessary, a wider ceramic heater element or multiple 6.5 mm ceramic heater elements can be used inside the metallic sleeve to increase the effective width of the heat zone.

Finally, the user of laser printer fuser technology ensures that the heater device 140 will last long enough to support at least five to seven years of use of the self-service terminal. Most low cost laser printers have a fuser element that are specified for five years of use at a rate of thirty thousand pages per month. A typical ATM dispenses significantly less than the equivalent to thirty thousand pages per month and thus adding a fuser element adapted from a laser printer will easily meet the lifetime requirements for an ATM.

To determine an optimal temperature for the heating element 240 in heater device 140, stability data for a known type pathogen, e.g., SARS-CoV-2, at different environmental conditions is first plotted to calculate a family of D values. The D value (decimal reduction time) is defined as the time in minutes at a given temperature that results in a one log reduction in microbial count. The family of D values are then plotted on a chart of log sanitization time values (minutes) versus temperature to form the Thermal Resistance Curve/Line of the pathogen. The slope of the resultant curve/line is used to calculate the z-value, i.e., the temperature change required for a one log sanitization time reduction of a microorganism. Data from a published article ("Stability of SARS-CoV-2 in different environmental conditions" The Lancet, Volume 1, ISSUE 1, e10, May 1, 2020) was processed in this manner and a z-value of 12.56° C. was calculated along with an x-intercept of 116° C. at 0.0001 minutes (i.e., 0.006 seconds). The x-intercept of TRC predicts that the viral load will be reduced by 90 percent in only 0.0001 minute (i.e., 6 msec) of exposure to a temperature of 116° C. The viral reduction table 300 shown in FIG. 3 was constructed, per the calculated z-value and x-intercept. Based on the data in table 300, when heating element 240 is set to 116° C., the viral load on a banknote or other media item will be reduced by 99.9999% when the roller speed in heater device 140 is set to provide 36 msec of contact (i.e., a roller speed of 181 mm/sec).

Figure 4:
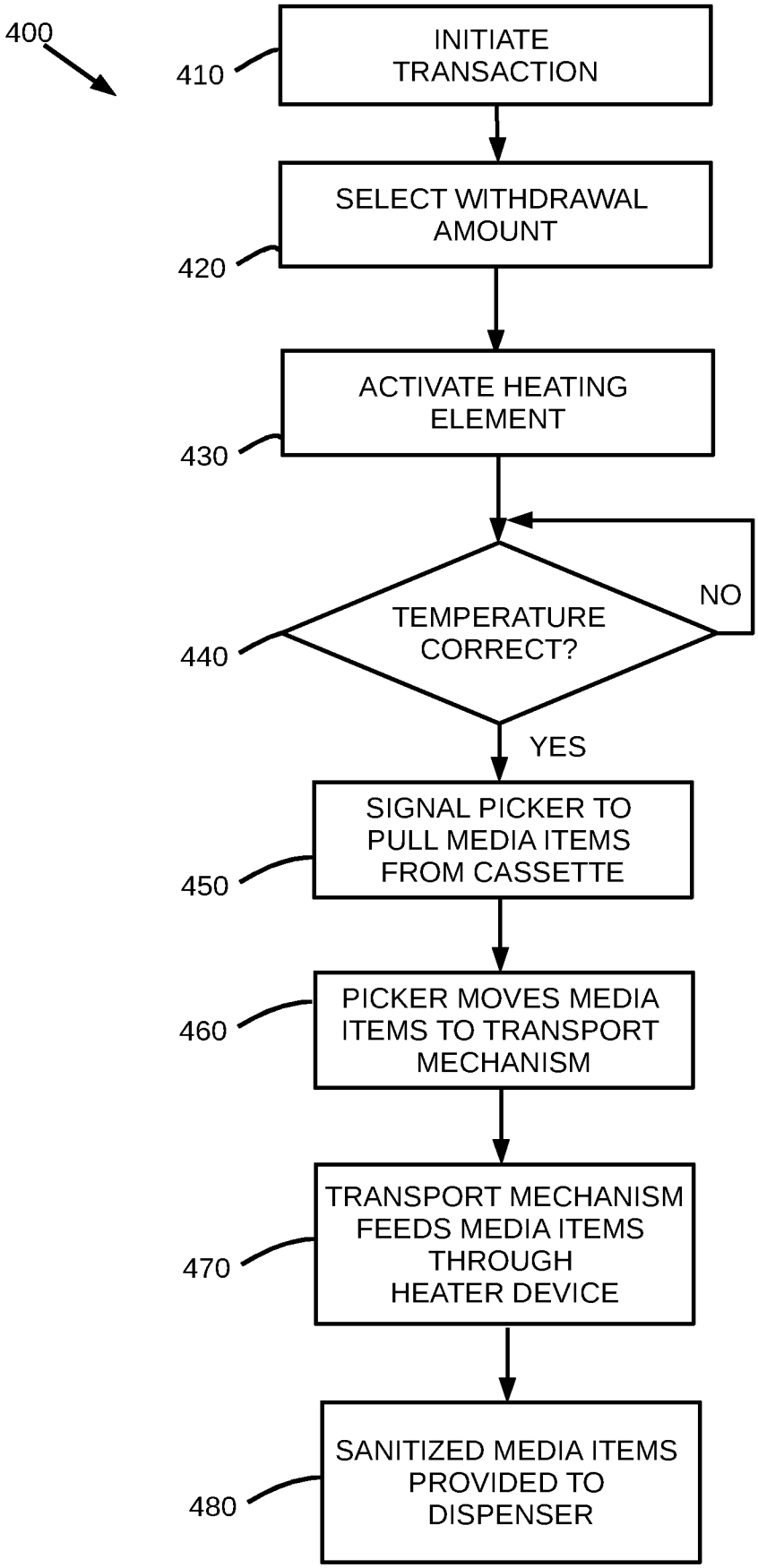
FIG. 4 is a flowchart of the operation of the sanitizing self-service terminal of FIG. 1.

Referring now to FIG. 4, a flowchart 400 is shown of the operation of the sterilizing self-service terminal 100 of FIG. 1. In a first step 410, a customer initiates a transaction at a self-service terminal by interacting with user interface 160. At step 420, the customer elects to withdraw or purchase a specified number of media items (e.g., banknotes or tickets) from the self-service terminal (i.e., the customer makes a customer request for a particular withdrawal or purchase). At step 430, controller 150 activates the heating element 240 in heater device 140. At step 440, the controller 150 checks the temperature at the heating element 240, and when the temperature reaches the predetermined value (e.g., 116° C.), processing moves to step 450 where the controller 150 enables the picker 120 to pull the specified number of media items from one or more of the cassettes 130. At step 460, the picker 120 moves the pulled media items to the transport mechanism 115. At step 470, the transport mechanism 115 feeds the media items to the heater device 140, sanitizing each of the media items as it passes under the heating element 240. Finally, at step 480, the sanitized media items are fed to the dispenser 110 for access to the customer.

The sanitizing self-service terminal 100 and method disclosed herein provides for thermal sanitization of banknotes or other media items as they are expelled from the terminal via a heated roller mechanism mounted in the output path within the terminal. By operating the heated roller mechanism at a temperature of 116° C. at a roller speed of 181 mm/sec, the sanitizing self-service terminal provides near instantaneous inactivation of pathogens such as SARS-Cov-2 virus present on the banknotes or other media items without harm to the structure of the banknotes or other media items, even when the banknotes or other media items are formed from a polymer.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A self-service terminal, comprising:

a bin for storing media items;

a transport mechanism having a pathway for selectively conveying a media item from the bin to a dispenser in order to complete a user transaction; and a heater device mounted in the pathway for sanitizing the media item as it is conveyed to the dispenser, the heater device adapted to quickly heat to a predetermined temperature upon an initiation of the user transaction.

2. The self-service terminal of claim 1, wherein the heater device comprises a heating element set to a predetermined temperature, the heating element mounted on a support element inside of a rotating sleeve, the heating element comprising a ceramic heater.

3. The self-service terminal of claim 2, wherein the predetermined temperature is 116° C.

4. The self-service terminal of claim 2, wherein the heater device comprises a roller driven by a motor set to move the media item past the heating element at a predetermined rate of speed.

5. The self-service terminal of claim 4, wherein the predetermined rate of speed is 181 mm/sec.

6. The self-service terminal of claim 4, wherein the heater device comprises a metallic sleeve adapted to rotate around the heating element as the media item moves past the heating element.

7. The self-service terminal of claim 4, wherein the heater device comprises a temperature sensor for detecting a temperature of the heating element.

8. The self-service terminal of claim 7, further comprising a controller for activating the heating element prior to conveying the media item to the dispenser.

9. The self-service terminal of claim 8, wherein the controller is coupled to the temperature sensor to ensure that the heating element is set to the predetermined temperature.

10. The self-service terminal of claim 1, further comprising:

a safety interlock switch coupled to a service panel that changes state when the service panel is opened; and a controller coupled to the safety interlock switch and to the heater device, the controller deactivating the heater device when the safety interlock switch indicates that the service panel is open.

11. A method of sanitizing a media item, comprising:

causing a heater device to quickly heat to a predetermined temperature upon an initiation of a current transaction;

initiating a transfer of a media item from a bin to a dispenser via a pathway in response to a customer request during the current transaction; and providing the media item to the heater device during the transfer of the media item via the pathway for sanitizing the media item as it is transferred to the dispenser.

12. The method of claim 11, further comprising setting a heating element in the heater device in a self-service terminal to a predetermined temperature, the heating element mounted on a support element inside of a rotating sleeve, the heating element comprising a ceramic heater.

13. The method of claim 12, wherein the predetermined temperature is 116° C.

14. The method of claim 12, wherein the heater device comprises a roller driven by a motor set to move the media item past the heating element at a predetermined rate of speed.

15. The method of claim 14, wherein the predetermined rate of speed is 181 mm/sec.

16. The method of claim 14, wherein the heater device comprises a metallic sleeve adapted to rotate around the heating element as the media item moves past the heating element.

17. The method of claim 14, wherein the heater device comprises a temperature sensor for detecting a temperature of the heating element.

18. The method of claim 17, comprising activating the heating element prior to transferring the media item to the dispenser.

19. The method of claim 18, wherein a controller is coupled to the temperature sensor to ensure that the heating element is set to the predetermined temperature.

20. The method of claim 11, comprising deactivating the heater device when a safety interlock switch indicates that a service panel is open.

* * * * *